US008235233B2

(12) United States Patent
Pehr

(10) Patent No.: US 8,235,233 B2
(45) Date of Patent: Aug. 7, 2012

(54) LATCH MECHANISM FOR A CLOSURE FOR A CONTAINER

(76) Inventor: Harold T. Pehr, Shawnee Mission, KS (US)

( * ) Notice: Subject to any disclaimer, the term of this patent is extended or adjusted under 35 U.S.C. 154(b) by 670 days.

(21) Appl. No.: 12/283,216

(22) Filed: Sep. 10, 2008

(65) Prior Publication Data

US 2010/0059471 A1 Mar. 11, 2010

(51) Int. Cl.

| | |
|---|---|
| ***B65D 55/02*** | (2006.01) |
| ***B65D 55/14*** | (2006.01) |
| ***B65D 50/00*** | (2006.01) |
| ***B65D 41/00*** | (2006.01) |
| ***A61J 1/00*** | (2006.01) |
| ***A61J 1/03*** | (2006.01) |

(52) U.S. Cl. ..... 215/237; 215/201; 215/207; 215/216; 215/224; 215/225; 215/305; 220/210; 220/315

(58) Field of Classification Search ..... 220/315, 220/538, 539, 540, 546, 550, 21, 210; 222/153.1, 222/153.14; 215/201, 216, 224, 225, 237, 215/243, 249, 305, 207

See application file for complete search history.

(56) References Cited

U.S. PATENT DOCUMENTS

| | | | | |
|---|---|---|---|---|
| 896,938 | A | 8/1908 | Ransom | |
| 1,168,066 | A * | 1/1916 | Girardot | 70/447 |
| 3,405,828 | A | 10/1968 | Pierre | |
| 3,604,581 | A | 9/1971 | Van Iperen | |
| 3,737,063 | A | 6/1973 | Loup | |
| 3,893,581 | A | 7/1975 | Kapphahn | |
| 4,353,483 | A | 10/1982 | Pehr | |
| 4,787,526 | A | 11/1988 | Pehr | |
| 4,925,041 | A | 5/1990 | Pehr | |
| 5,137,260 | A | 8/1992 | Pehr | |
| 5,147,054 | A * | 9/1992 | Pehr | 215/253 |
| 5,149,153 | A * | 9/1992 | Drewry et al. | 292/104 |
| 5,328,049 | A * | 7/1994 | Ritzow | 220/315 |
| 5,419,598 | A * | 5/1995 | Kreitzer | 292/230 |
| 5,464,109 | A | 11/1995 | Greenwald | |
| 5,649,646 | A * | 7/1997 | Foster et al. | 222/153.14 |
| 5,873,475 | A | 2/1999 | Volpe | |
| 5,911,764 | A | 6/1999 | Wei Kong | |
| 6,733,053 | B2 * | 5/2004 | Hodge et al. | 292/336.3 |
| 6,793,081 | B1 | 9/2004 | Derman | |
| 6,804,906 | B1 * | 10/2004 | Olsen | 42/70.11 |
| 6,848,603 | B2 * | 2/2005 | Gaiser et al. | 222/153.1 |
| 6,902,080 | B2 * | 6/2005 | Busch | 220/315 |
| 7,731,048 | B2 * | 6/2010 | Teixeira Alvares et al. | 220/270 |
| 2005/0211658 | A1 | 9/2005 | Bagration De Ulloa | |
| 2006/0207958 | A1 | 9/2006 | Hamer | |

* cited by examiner

*Primary Examiner* — Anthony Stashick
*Assistant Examiner* — Madison L Wright
(74) *Attorney, Agent, or Firm* — John C. McMahon

(57) ABSTRACT

A container for over-the-counter drugs or the like that includes a cylindrical plastic bottle with a closure. The closure including a cap and a ring that mates with the mouth of the bottle. The cap ring has a tongue that mates with a capture structure on the cap in a child resistant configuration. The tongue being lockable by a pad lock to block access by unwanted adults and teenagers. The tongue having a senior friendly configuration also.

2 Claims, 2 Drawing Sheets

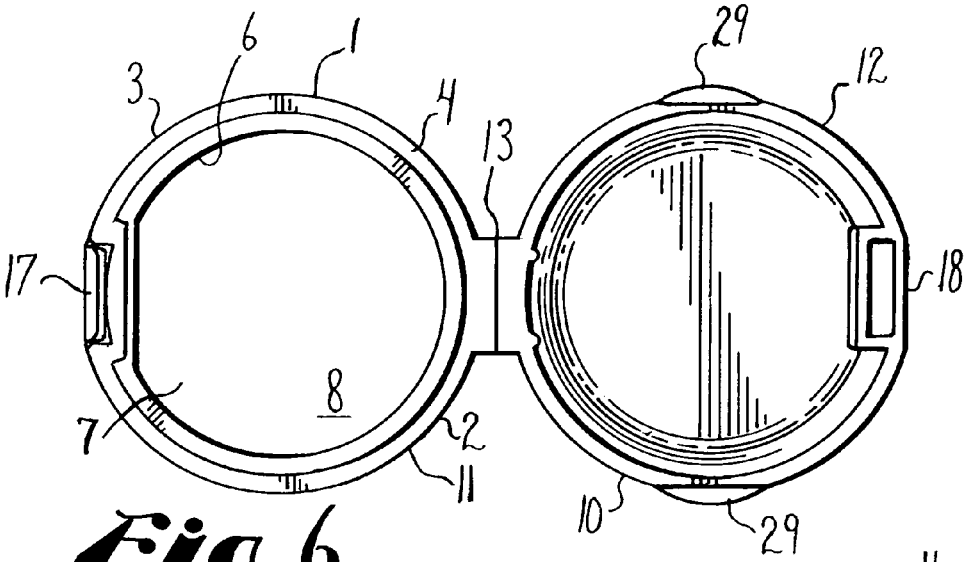
Fig. 6.
Fig. 7.
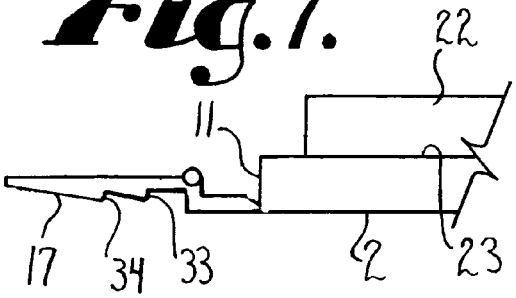
Fig. 8.
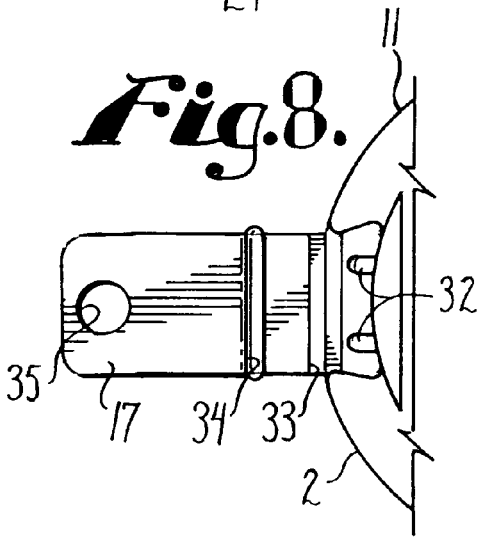
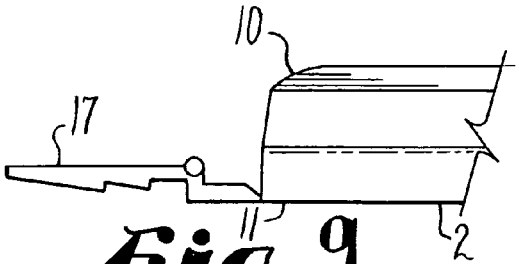
Fig. 9.
Fig. 10.
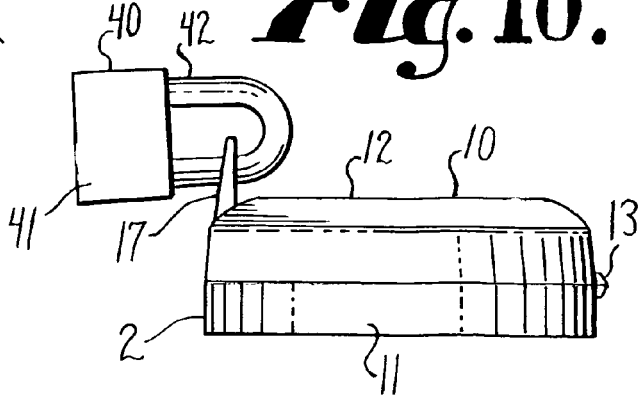

LATCH MECHANISM FOR A CLOSURE FOR A CONTAINER

BACKGROUND OF THE INVENTION

This invention is directed to a tamper proof container that is child resistant, unwanted use by adolescents and adults resistant, while be senior friendly and easily accessed by the owner of the medication.

Often specific medicine is targeted for theft by teenagers and other undesirable users. Because adolescents and other adults can operate the child safety mechanisms that are focused on convention prescription medicine containers, such mechanisms do nothing to prevent unwanted users from entering bottles and taking contents.

Bottles also need to be child resistant to prevent small children from accidently taking medication, when protection against teenagers and adults is not in use. Seniors with arthritis and the like often have difficulty opening the child resistant locks however, causing them to have difficulty in accessing their medications.

Therefore, there is a need for simple, safe reliable container for over-the-counter drugs and the like utilizing a latch mechanism that provides child resistance that can be senior friendly and can also provide protection against theft for a prescription bottle. Further, such a latch mechanism needs to be available for other medicine holding devices such as multiple day pill dispensers or where a container holds deadly or harmful materials, such as some aerosol containers.

SUMMARY OF THE INVENTION

The present invention provides a user of prescription pills or other items requiring oversight with three use configurations in a practical way. The bottles are child resistant, if latch tongue is placed to engage a capture structure, senior friendly, if the latch tongue is rotated to a non engagement position with the capture structure, and anti-theft, if the latch tongue has a lock placed through it to prevent passage through the capture structure.

The latch mechanism of the closure is created specifically to allow the tongue to be swung between engagement with and non engagement with the capture structure and is equipped with a bore in a distal end of the tongue for receiving a lock for locking the container. The bottle includes a cap that snaps over a mouth of the bottle so that the cap seals a mouth of the bottle even with the latch tongue is in the non engagement position.

The latch tongue is braced against capture structure when received therein and has a lip that extends over the capture structure, such that the tongue must be braced backward by a user to open the container, thereby making the latch mechanism also resistant to infants and small children. In one embodiment, the latch tongue includes a second lip that spaced distally of the first lip that also engages the capture structure, requiring a further degree of understanding to open the lid in the child resistant configuration.

The closure can be used on various containers, particularly pill bottles, but also daily pill holders, aerosol bottles and the like. The latch mechanism provides alternative multi function protection while allowing access to pill bottles and the like to those who are intended to use them.

OBJECTS AND ADVANTAGES OF THE INVENTION

The principal objects of the present invention are: to provide a child and theft resistant container for over-the counter drugs; dangerous compositions and the like; to provide such a container which is easily adaptable for senior use, yet extremely reliable; to provide such a container which has a latch mechanism using a pivotal tongue; to provide such a latch mechanism where the tongue can be moved to engage capture structure and there after be locked with a pad lock or alternatively to move so as to not engage the capture structure and be senior friendly or relatively easy to open; to provide such a closure that will still fit snug against the mouth of the container with the latch in the senior friendly configuration; to provide a closure that can be secured with a lock; and to provide such a container and closure that is easy to use, inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 6 is an enlarged, top plan view of the container, with the tongue of the closure mechanism in a capture mechanism engagement position and with the cap open.

FIG. 7 is an enlarged and fragmentary side elevational view of the closure, illustrating the cap open with the tongue in a senior friendly configuration.

FIG. 8 is an enlarged and fragmentary top plan view of the cap and closure and illustrating the tongue in the user friendly configuration.

FIG. 9 is an enlarged and fragmentary side elevational view of the closure illustrating the cap closed with the tongue in the senior friendly position.

FIG. 10 is an enlarged and fragmentary side elevational view of the closure, illustrating the cap closed and locked with a padlock.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
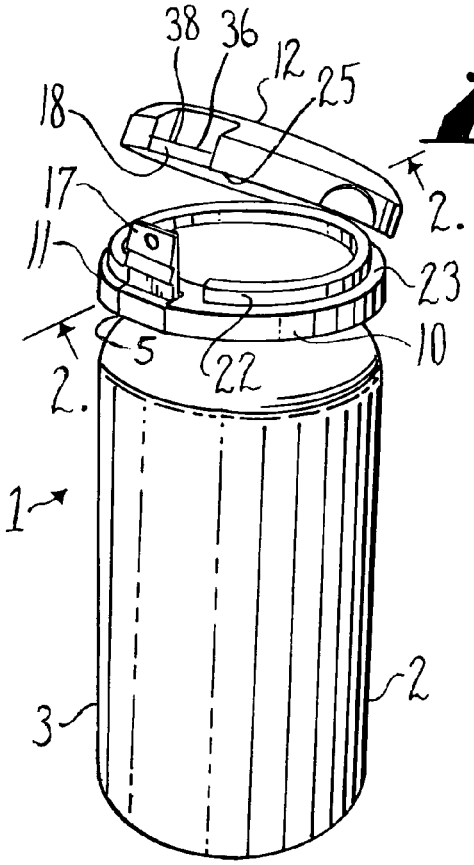
FIG. 1 is a perspective view of a fully assembled container in accordance with the present invention having a closure with a cap in an open position thereof.

Referring to FIG. 1, there is shown a tamper resistant and tamper evident container 1 that can be easily converted to be senior friendly in accordance with the present invention. The container 1 comprises of a generally cylindrical bottle 2 of a type used to dispense prescriptions or the like, a larger bottom portion 3, a tapered portion 4, a smaller neck portion 5 ending at a mouth or opening 6 and a bottom 7 forming an enclosed or sealed cavity 8 except at the mouth 6. Access to the container mouth 6 is controlled by a closure mechanism 10.

The closure mechanism 10 comprises a ring 11, a cap 12, a hinge 13, and a latch mechanism 14 having a tongue 17 and a tongue capture structure 18.

The ring 11 is continuous and circular forming the mouth 6 on the inside side thereof. The ring 11 is fixedly and non-removably joined to this container bottle 2 so as to be integral therewith. It is foreseen that the ring could be non-integral with the bottle 2, but fixedly secured thereto by interlocking parts, glueing or the like. The ring 11 includes an inner upstanding partial wall 22 and an upper mating surface 23 radially outward of the wall 22.

The cap 12 is sized and shaped to cover the mouth 6 and mate with the ring 11. The cap 12 has a lower surface 25 that mates with and seals against the ring mating surface 23 when the cap 12 is closed. The cap 12 includes a top 27 and a depending skirt 28 attached to and fully surrounding the top 27. The cap 12 includes finger grasping projections 29 on radially opposite sides thereof.

Figure 2:
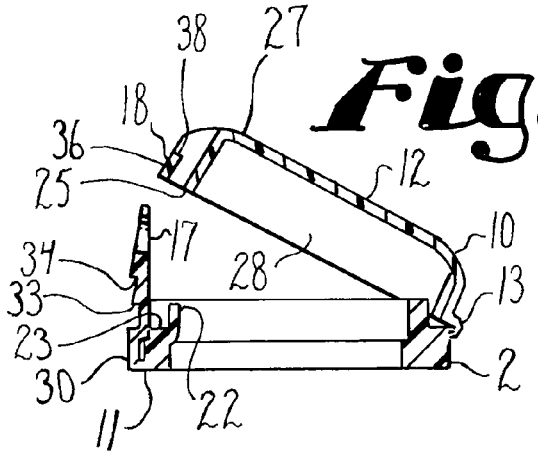
FIG. 2 is an enlarged and fragmentary perspective view of the closure, taken along line 2-2, with the cap open.

The ring 11 is pivotally secured to cap 12 by the hinge 13 to allow the cap 12 to rotate relative to the ring 11 about the hinge 13, as is seen in FIG. 2.

Figure 3:
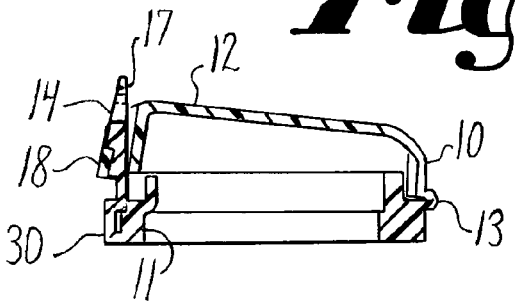
FIG. 3 is an enlarged and fragmentary cross-sectional view similar to FIG. 2, of the closure, illustrating a tongue of the closure in a position wherein the tongue is within a capture structure, but prior to being sealed shut.
Figure 4:
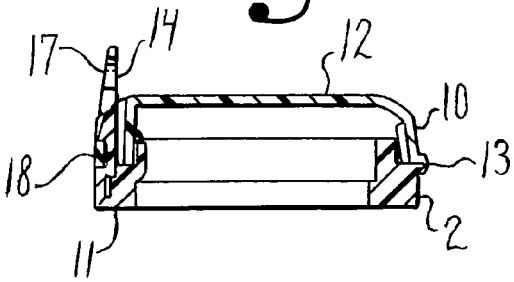
FIG. 4 is an enlarged and fragmentary perspective view of the closure taken similar to FIG. 2 and illustrating the cap closed.

The latch mechanism 14 offers a user a choice of at least two options. The tongue 17 is pivotally attached at a base 30 thereof to the ring diagonally from the hinge 13. The tongue 17 can be rotated between an upward or capture structure engaging position as seen in FIGS. 2 to 4 or an outward non capture engaging position as seen in FIGS. 7 to 9. When in the capture engaging position, the tongue 17 and by a pair of beads 32 (see FIG. 8) located on the ring 11 behind the tongue 17.

The tongue 17 includes a first bar or lip 33 extending across the radially outer side when in the capture structure engaging position that is positioned to extend over the capture structure 18 when the cap 12 is fully closed, as is seen in FIG. 4. The tongue 17 includes a second bar or lip 34 spaced from the first lip 33 and more distally on the tongue 17. Spaced outwardly on the tongue 17 opposite the base 30 is a pass through aperture or bore 35 (see FIG. 8). The tongue 17 is sized and shaped such that the bore 35 is located away from the capture structure when the cap is closed and accessible for locking as noted below.

Figure 5:
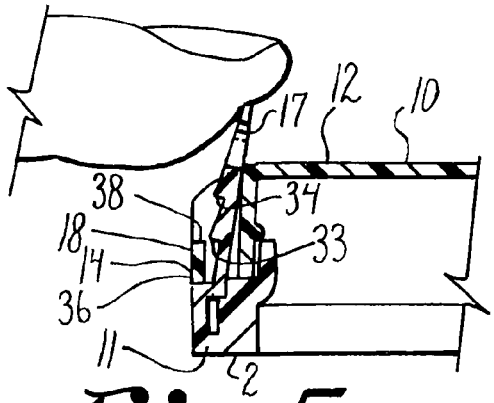
FIG. 5 is an enlarged and fragmentary perspective view of the closure, similar to FIG. 2 and illustrating a method of disengaging the tongue from the capture mechanism.

The capture structure 18 of this embodiment includes a loop 36 that forms a fully enclosed passageway with the ring 11 that receives the tongue 17 when the tongue 17 is in the capture structure engaging position. The loop 36 has an upper surface 38 that engages the lips 33 and 34 which are biased toward the loop 36 when therein. To release the lips 38 and then 34 from the loop 36, the tongue 17 must be depressed or pushed at the distal end thereof toward the cap 12; as seen in FIG. 5. It is foreseen that the capture structure could be placed on the ring and the tongue could be placed on the cap.

A lock 40 can be placed through the bore 35 when the cap is closed and the tongue 17 is in the capture structure 18, as seen in FIG. 10, to prevent non-destructive access to the contents by unwanted teenagers or adults. The lock 40 is a key activated lock 41 with a bar 42 that loops through the bore 35. However, it is foreseen that combination padlocks or other types of locks could be used.

FIGS. 7 to 9 show the tongue 17 in a senior friendly configuration where it is easy to open the container. In FIGS. 7 and 8, the lid 12 is in an open position and in FIG. 9 it is in a closed position.

FIGS. 2 to 5 show the tongue in a child resistant configuration. In FIG. 2 the cap 12 is in the open position. FIG. 5 shows the first step in opening where the tongue 17 is depressed by a user to allow the lip 33 to clear the loop 36 after which the cap 12 can be opened until the second lip 34 is encountered (see FIG. 3) after which the process is repeated.

If the user wants to ensure that teenagers or other adults do not have access to the contents of the container 1, the lock 40 is secured through the bore 35 which prevents the tongue from being withdrawn from the capture structure 18.

It is foreseen that the present invention of locking can be used in conjunction with a wide variety of closures, including but not limited to non-hinged caps, caps having only a portion of the top thereof that opens which can be both hinged or non-hinged, various pill containers, aerosol nozzle covering caps, and the like.

It is to be understood that while certain forms of the present invention have been illustrated and described herein, it is not to be limited to the specific forms or arrangement of parts described and shown.

What is claimed and desired to be secured by Letters Patent is as follows:

1. A closure adapted for use on a medicine container comprising:

a) a ring including structure for securing the ring to the medicine container; the ring having a first side and an opposite second side; and b) a lid with a first and second side; the lid first side hingedly joined to the ring on the ring first side and the ring and the lid including first and second portions of a latch on the second sides of the ring and the lid; the first portion of the latch is attached to one of the ring and lid and the second portion of the latch is attached to an opposite;

c) the latch first portion comprises a tongue hingedly attached to the appropriate ring/lid; and d) the latch second portion comprises a closed loop attached to the appropriate ring/lid;

e) the tongue is sized and shaped to pass through the closed loop in alternative first and second different locking configurations; in the first locking configuration the tongue includes a lip that is received on and biased toward an edge of the loop, such that in the first locking configuration the tongue must be pushed away from the loop edge to free the tongue from the loop and allow the tongue to pass through the loop for opening in such a manner as to provide resistance to opening by small children; in the second locking configuration, the tongue is secured by a lock placed on the tongue after passage through the loop so that the tongue cannot be passed through the loop until the lock is removed in such a manner as to provide resistance to opening by teenagers and adults; and wherein f) the tongue is also hingedly swingable to a non latched configuration wherein the lid is closeable against the ring and operable in a senior friendly manner.

2. A latch mechanism for a medicine dispensing closure used on a container wherein the closure includes a lid and a ring with a mouth opening that is blocked by the lid in a closed position and that is accessible when the lid is in an open position; the latch mechanism comprising:

a) a tongue pivotally connected to a first of the lid and the ring;

b) a tongue capture structure comprising a closed loop attached to a second of the lid and the ring such that the tongue and capture structure are never to only one of the lid and the ring;

c) the tongue having a first senior friendly position wherein the tongue is pivoted so as not to engage the capture structure when the lid is in the closed position and provide for comparatively easy opening of the lid relative to the container';

d) the tongue having a second position wherein the tongue extends through the loop upon closure of the lid in different first and second latching configurations; the tongue having a pass through bore near a distal end of the tongue and outwardly of the capture structure when passing through the loop;

e) in the first latching configuration the tongue has a lip that is biased toward the loop when the tongue is in the loop, the lip being positioned so that the lip extends over and engages the loop when the lid is closed against the ring so as to seal the lid against the ring, the tongue having to be depressed by a user to allow the tongue to be released from the capture structure so as to provide resistance against small children opening the lip in the second position; and f) in the second latching configuration the tongue extends through the loop and the latch mechanism includes a lock having that is sized and shaped to pass through the tongue bore, such that when the lock is placed on the tongue in a locked configuration while the tongue is in the capture structure loop, the lid cannot be opened until the lock is disengaged from the tongue, so as to provide resistance against older children opening the lid.

* * * * *